United States Patent [19]

Oskam

[11] Patent Number: 4,974,657

[45] Date of Patent: Dec. 4, 1990

[54] TAPE SPACER

[75] Inventor: Herman Oskam, Vlist, Netherlands

[73] Assignee: Hunter Douglas International N.V., Curacao, Netherlands

[21] Appl. No.: 419,286

[22] Filed: Oct. 10, 1989

[30] Foreign Application Priority Data

Nov. 4, 1988 [GB] United Kingdom ..... 8825872

[51] Int. Cl.[5] ..... E06B 9/30

[52] U.S. Cl. ..... 160/178.1

[58] Field of Search ..... 403/397, 405.1, 406.1; 160/178.1, 168.1, 176.1

[56] References Cited

U.S. PATENT DOCUMENTS

| | | | |
|---|---|---|---|
| 2,482,036 | 9/1949 | Stutz | 160/178.1 X |
| 2,647,573 | 8/1953 | Meyer | 160/178.1 |
| 2,877,487 | 3/1959 | Haislip | 160/178.1 X |

FOREIGN PATENT DOCUMENTS

| | | | |
|---|---|---|---|
| 476681 | 9/1951 | Canada | 160/178.1 |
| 263884 | 12/1949 | Switzerland | 160/178.1 |

*Primary Examiner*—Blair M. Johnson

*Attorney, Agent, or Firm*—Pennie & Edmonds

[57] ABSTRACT

A tape spacer for securing the ladder tape of a venetian blind slat of a given width. It includes a body (10) having a length slightly greater than the width of the slat. A single hook (16) is provided on one end and two laterally spaced hooks (20 and 24) on the other end. The body is angled to position these loosely adjacent the edges and the handle (28) is then operated to spring the third hook (24) over the other edge of the slat.

10 Claims, 1 Drawing Sheet

TAPE SPACER

The present invention relates to a tape spacer for securing the ladder tape of a venetian blind to a blind slat of a given width.

It is conventional in certain types of venetian blind to secure the uppermost slat firmly to the associated rungs of the ladder means such as a ladder cord usually with a spacer of generally rectangular shape, this having hooks on opposite sides of the spacer body to enable the body to be secured snugly against the associated slat, with the rung of the ladder sandwiched between the slat and the spacer body. This works very satisfactorily but can be quite a difficult and time consuming operation to position the relatively small spacer on the slat which makes the fitting uneconomic, especially when used with the latest type of thin, small venetian blind slats, e.g. 12 or 18 mm in width; such positioning holds the risk of failure or slat damage.

It is now proposed, according to the present invention, to provide a tape spacer for securing the ladder means of a venetian blind to a blind slat of a given width defined by first and second slat edges, said spacer comprising a body of a length slightly in excess of said given width, a single, first projecting part at one end of the body adapted to holdingly cooperate with the first edge of the slat and second and third projecting parts at the other end of the body and projecting from the same face of the body as the first part, the second and third projecting parts being laterally spaced from one another, with the first projecting part being positioned, in the lateral direction of the body between the second and third projecting parts, so that the spacing between the first and second projecting parts is approximately equal to the width of the slat to facilitate simultaneous positioning of the first and second projecting parts over the first and second slat edges, the spacer then being turnable to a position whereby the third projecting part can be made to abuttingly engage said second slat edge to hold the spacer in place.

With such a structure it is relatively easy to position the first and second hooks because the distance between them is approximately equal to the width of the slat, so that one either needs only a very slight pushing force on the slat edges or none at all to put the spacer onto the slat. A simple turning of the spacer then holds these two hooks firmly in place and all that one has then to do is to bring the third hook over the second edge of the slat. This can be facilitated if the hook is mounted on a resilient arm, which is flexible towards the second hook to enable the third hook to be brought to grip the second edge with little or no slat pinching.

The operation can be made even simpler if the resilient arm is provided with an extension handle, to enable a greater lever force to be exerted to bring the third hook into place, and said external handle is preferably provided with a point of weakness whereby said handle can be broken off easily after use.

A spacer body can have a number of configurations, but advantageously the resilient arm is angled on one lateral side of the body towards said third hook and a rigid arm portion of said body is angled on the other lateral side towards said second hook.

In order further to facilitate holding the ladder means, preferably the end portions of the body are each provided with a recess to receive the rungs of the ladder adjacent where they join the upright side members of the ladder.

Advantageously said body is a generally plate-like member, preferably but not necessarily, of plastics material, which is bowed to enable it to be engaged snugly with a concave face of a bowed venetian blind slat.

In order that the invention may more readily be understood, the following description is given, merely by way of example, reference being made to the accompanying drawings, in which.

Figure 1:
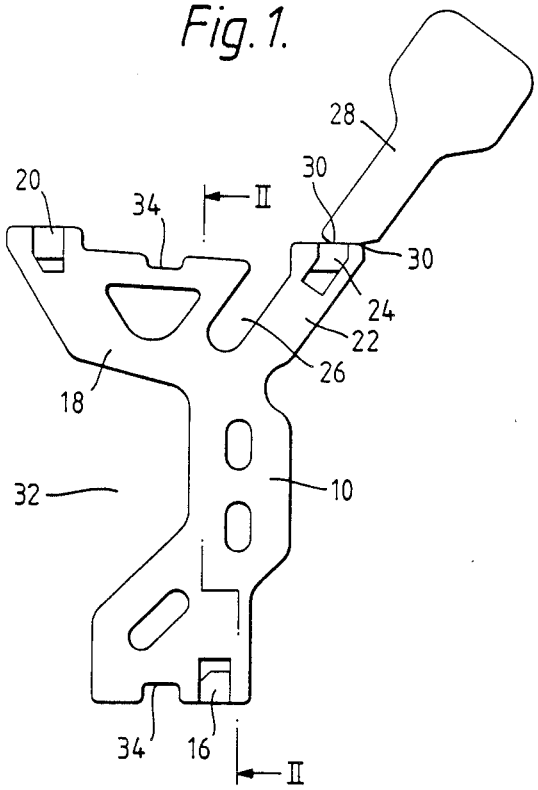
FIG. 1 is a plan view of a preferred embodiment of tape spacer according to the present invention.
Figure 2:
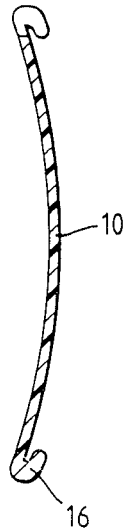
FIG. 2 is a cross-section of the spacer along the line II—II of FIG. 1.
Figure 3:
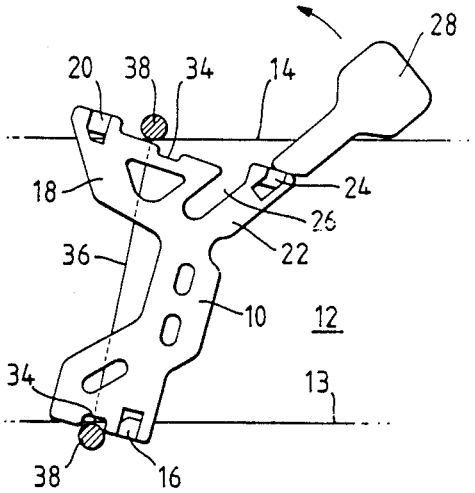
FIGS. 3 and 4 are schematic views showing the spacer being positioned on the lower side of a slat.
Figure 4:
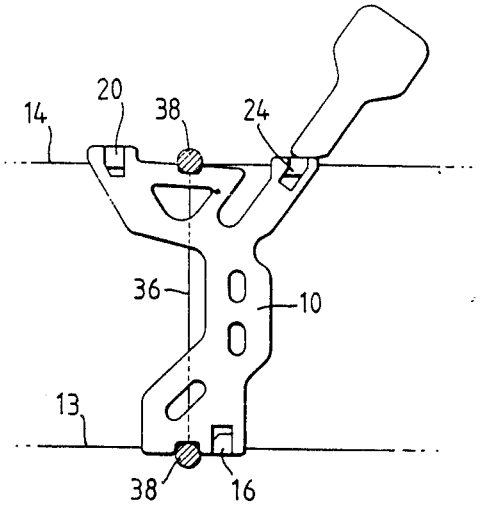

Referring first to FIGS. 2 and 3, there is indicated therein a spacer according to the invention, including a body 10 mounted on a venetian blind slat 12 having a first edge 13 and a second edge 14.

The body 10 is provided adjacent the first edge 13 with a first hook 16 bent downwardly, to project from one face of the body 10, as indicated in FIG. 2. The body 10 includes a substantially rigid laterally extending body portion 18 provided with a second hook 20, similar to the hook 16 and also bent downwardly to project from the same face.

A resilient arm 22 is also formed on the body 10 and is angled in the opposite direction and has, at its free edge, a third hook 24 of similar shape to the first and second hooks. A gap 26 is provided between the resilient arm 22 and the body portion 18, the arm 22 being capable of being flexed towards the second hook 20.

Forming an extension to the resilient arm 22 is an external handle 28. At the point where the external handle 28 meets the resilient arm 22, there are two points of weakness 30 for a reason to be explained later.

At the centre, the body 10 is provided with recess 32 for the passage of a lift cord of the venetian blind (if provided) and at the ends, the body is provided with recesses 34 for accommodating a rung of the ladder where it joins the upright side cords of the ladder.

In operation, with a ladder type in place and having a ladder tape rung 36 extending across the slat, and upright cords 38 extending vertically, the spacer of the invention is positioned as shown in FIG. 3 over the rung 36. In this orientation, the first hook 16 and the second hook 20 are located just outwardly of the edges 13 and 14 respectively, the distance between the hooks 16 and 20 being slightly greater than the width of the slat 12. By operation of the handle 28, the spacer is rotated anticlockwise and the first and second hooks 12 and 16 engage the edges 13 and 14 respectively. Continued operation of the handle 28 in this manner causes the arm 22 to flex inwardly, so that the third hook 24 is moved towards the second hook 20 and can thus be engaged over the edge 14 to retain the spacer in place. The handle 20 can then be broken, twisted or cut off at the points of weakness 30.

The recesses 34 are then located at the junction of the ladder tape rung 36 with the upright cords 38.

It will be appreciated that the positioning of the spacer of the invention is extremely simple and can be carried out much more quickly and readily than hitherto.

I claim:

1. A tape spacer for securing the ladder means of a venetian blind to a slat of the blind having a given width defined by first and second slat edges, said spacer comprising:

(a) a body of a length slightly in excess of said given width, said body having one end and another end;

(b) a single first projecting part at said one end of said body, said first projecting part projecting from one face of the body effective to holdingly cooperate with said first slat edge;

(c) second and third projecting parts at said other end of said body, said second and third projecting parts also projecting from said one face of said body; said second and third projecting parts being laterally spaced from one another, with the first projecting part being positioned, in the lateral direction of the body, between the second and third projecting parts, and the spacing between the first and second projecting parts being approximately equal to said given width of the slat to facilitate simultaneous positioning of the first and second projecting parts over the first and second edges of the slat, the spacer then being turnable to a position whereby the third projecting part can be made to abuttingly engage said second edge, effective to hold said spacer in place; and (d) an extension handle having one end connected adjacent the third projecting part and a free end spaced therefrom to enable a greater lever moment to be exerted to bring said third projecting part into place.

2. A tape spacer as claimed in claim 1, and further comprising a notch or recess on at least one of said projecting parts firmly to accommodate the associated edge of a slat.

3. A tape spacer as claimed in claim 2, wherein said projecting parts are in the form of hooks.

4. A tape spacer as claimed in claim 1, and further comprising means defining a point of weakness provided on said extension handle, whereby said handle can be broken off after use.

5. A tape spacer as claimed in claim 1, wherein said ends of said body further comprise a recess to receive a rung of the ladder means adjacent where it joins the upright of the ladder means.

6. A tape spacer for securing the ladder means of a venetian blind to a slat of the blind having a given width defined by first and second slat edges, said spacer comprising:

(a) a body of a length slightly in excess of said given width, said body having one end and another end;

(b) a single first projecting part at said one end of said body, said first projecting part projecting from one face of the body effective to holdingly cooperate with said first slat edge;

(c) second and third projecting parts at said other end of said body, said second and third projecting parts also projecting from said one face of said body; said second and third projecting parts being laterally spaced from one another, with the first projecting part being positioned, in the lateral direction of the body, between the second and third projecting parts, and the spacing between the first and second projecting parts being approximately equal to said given width of the slat to facilitate simultaneous positioning of the first and second projecting parts over the first and second edges of the slat, the spacer then being turnable to a position whereby the third projecting part can be made to abuttingly engage said second edge, effective to hold said spacer in place; and (d) a resilient arm on which said third projecting part is mounted, said resilient arm being flexible towards the second projecting part to enable the third projecting part to be sprung onto said second slat edge.

7. A tape spacer as claimed in claim 6, wherein said resilient arm is angled on one lateral side of the body towards the third projecting part and further comprising a rigid arm portion of said body angled on the other lateral side thereof towards said second projecting part.

8. A tape spacer for securing the ladder means of a venetian blind to a slat of the blind having a given width defined by first and second slat edges, said spacer comprising:

(a) a body of a length slightly in exces of said given width, said body having one end and another end;

(b) a single first projecting part at said one end of said body, said first projecting part projecting from one face of the body effective to holdingly cooperate with said first slat edge;

(c) second and third projecting parts at said other end of said body, said second and third projecting parts also projecting from said one face of said body; said second and third projecting parts being laterally spaced from one another, with the first projecting part being positioned, in the lateral direction of the body, between the second and third projecting parts, and the spacing between the first and second projecting parts being approximately equal to said given width of the slat to facilitate simultaneous positioning of the first and second projecting parts over the first and second edges of the slat, the spacer, then being turnable to a position whereby the third projecting part can be made to abuttingly engage said second edge, effective to hold said spacer in place;

(d) a resilient arm on which said third projecting part is mounted, said resilient arm being flexible towards the second projecting part to enable the third projecting part to be sprung onto said second slat edge; and (e) an extension handle, forming an extension of said resilient arm, effective to enable a greater lever moment to be exerted to bring said third projecting part into place.

9. A tape spacer for securing the ladder means of a venetian blind to a slat of the blind having a given width defined by first and second slat edges, said spacer comprising:

(a) a body defined by a generally plate-like member which is bowed to enable it to be engaged snugly with a concave face of a bowed venetian blind slat, said body being of a length slightly in excess of said given width, said body having one end and another end;

(b) a single first projecting part at said one end of said body, said first projecting part projecting from one face of the body effective to holdingly cooperate with said first slat edge;

(c) second and third projecting parts at said other end of said body, said second and third projecting parts also projecting from said one face of said body; said second and third projecting parts being laterally spaced from one another, with the first projecting part being positioned, in the lateral direction of the body, between the second and third projecting parts, and the spacing between the first and second projecting parts being approximately equal to said given width of the slat to facilitate simultaneous positioning of the first and second projecting parts over the first and second edges of the slat, the spacer then being turnable to a position whereby the third projecting part can be made to abuttingly engage said second edge, effective to hold said spacer in place.

10. A tape spacer for securing the ladder means of a venetian blind to a slat of the blind having a given width defined by first and second slat edges, said spacer comprising:

(a) a body of a length slightly in excess of said given width, said body having at least one aperture for the passage of a venetian blind lift means and further having one end and another end;

(b) a single first projecting part at said one end of said body, said first projecting part projecting from one face of the body effective to holdingly cooperate with said first slat edge;

(c) second and third projecting parts at said other end of said body, said second and third projecting parts also projecting from said one face of said body; said second and third projecting parts being laterally spaced from one another, with the first projecting part being positioned, in the lateral direction of the body, between the second and third projecting parts, and the spacing between the first and second projecting parts being approximately equal to said given width of the slat to facilitate simultaneous positioning of the first and second projecting parts over the first and second edges of the slat, the spacer then being turnable to a position whereby the third projecting part can be made to abuttingly engage said second edge, effective to hold said spacer in place.

* * * * *